United States Patent [19]

Penton

[11] 4,117,616

[45] Oct. 3, 1978

[54] REFLECTORIZED SYMBOL SIGN AND METHOD OF FABRICATING AND ASSEMBLING

[75] Inventor: Hugh V. Penton, San Marino, Calif.

[73] Assignee: California Metal Enameling Company, Los Angeles, Calif.

[21] Appl. No.: 743,285

[22] Filed: Nov. 19, 1976

[51] Int. Cl.[2] ..... G09F 13/00

[52] U.S. Cl. ..... 40/550; 40/562

[58] Field of Search ..... 350/97, 105, 106; 40/130 J, 133 R, 125 A, 550, 562

[56] References Cited

U.S. PATENT DOCUMENTS

| | | | |
|---|---|---|---|
| 1,083,362 | 1/1914 | Grahmann | 40/133 R X |
| 2,165,835 | 7/1939 | Brady et al. | 40/133 R |
| 2,212,454 | 8/1940 | Porter | 40/133 R |
| 3,399,477 | 9/1968 | Johnson, Jr. et al. | 140/130 J |
| 4,047,802 | 9/1977 | Pieters | 350/97 |

FOREIGN PATENT DOCUMENTS

| | | | |
|---|---|---|---|
| 265,743 | 7/1929 | Italy | 40/130 J |

*Primary Examiner*—Louis G. Mancene
*Assistant Examiner*—Wenceslao J. Contreras
*Attorney, Agent, or Firm*—Mahoney, Schick & Cislo

[57] ABSTRACT

Adhesive backed information and border sign symbols are formed from finished metal sheet or coil which has initially applied to a back surface thereof adhesive covered by release paper. Reflectors are mounted in openings of the sign symbols retained therein through symbol opening edge portions preferably partially overlying and preferably partially edge pressure engaging the reflectors, the information symbols such as letters, numbers and arrows having a multiplicity of spaced reflectors, and the border symbols being elongated and also having said spaced reflectors. The sign is assembled by removing the release paper from the symbols and adhesively adhering the symbols to a finished front face of a sign panel, the information symbols being positioned inwardly of a sign panel border portion and the border symbols being positioned at the sign panel border portion circumscribing the information symbols.

8 Claims, 8 Drawing Figures

REFLECTORIZED SYMBOL SIGN AND METHOD OF FABRICATING AND ASSEMBLING

BACKGROUND OF THE INVENTION

This invention relates to a reflectorized sign symbol, a reflectorized symbol sign, and methods of fabricating and assembling the same, and more particularly, to such symbols, signs and methods wherein the sign symbols are formed in a new and unique manner so as to be readily adaptable for forming virtually any size and shape of reflectorized sign conveying virtually any information desired. Furthermore, any sign so formed may be conveniently assembled from the particularly contructed sign symbols directly at the erection site and in markedly less time than has heretofore been required for the similar prior sign constructions. Still further, after a period of use of any of the uniquely formed sign symbols and signs of the present invention, the sign symbols of the particular sign, due to the particular manner of attachment to a sign panel, may be relatively easily removed and replaced for either sign symbol renewal to convey the same information or replacement to convey new and different information, while still using the same basic sign panel and without any later indication that such sign symbol renewal or replacement has been made.

In the more modern sign constructions, reflectorization of the sign symbols including both the information and border symbols by the use of appropriate reflectors positioned thereon have been quite extensively used, a prime example thereof being the more recent highway and freeway signs. As a matter of fact, many of the present state and city highway codes, due to the vast increase in traffic congestion through the years, now require that all or at least most highway signs will be what is termed "fail-safe". This means that even though these highway signs are either fully lighted or are in areas that are maintained fully artifically lighted during the night hours, these signs must be fully reflectorized so as to be readily distinguishable in the event of power failures or the malfunction of the power supply to the particular sign. With the signs being fully reflectorized, the signs can still be fully distinguishable by virtue of relatively minor light sources and particularly at least by virtue of the headlights of the motor vehicles using the highways.

One of the more common means of providing reflectorized signs prior to the present invention has been the formation of the letters, numbers, directional arrows, and sometimes borders of the signs, from embossed aluminum or steel sheets. The letters are formed with rearwardly directed beveled edges which retain the major portion of the particular sign symbols spaced forwardly of the particular sign panel face upon which such symbols are to be mounted. Reflector holes are then punched in the sign symbols at appropriate locations and the reflectors are inserted from rearwardly of the sign symbol through the reflector holes where they are permanently positioned in the rigid metal sign symbols by heat sealing.

In the assembly of the final sign, after the exact positioning of each of the sign symbols is determined as to its location on the sign panel face, the sign symbols are attached to the sign panel face by rivets. This requires that each of the sign symbols will be temporarily securely retained at its particular final position while rivet holes are drilled through the beveled edges of the sign symbol and simultaneously through the sign panel. Following, the attaching rivets are inserted and pulled to complete the rivet attachment thereby permanently securing the sign symbols to the sign panel face. A further consideration in the use of rivets for sign symbol attachment is that if the sign panel or the sign symbols are formed of steel, the rivet holes once formed must be treated to prevent the future rusting of the metal at such rivet holes.

Now, with this sign construction procedure in mind, it can be easily appreciated that with all of the apparent difficulties encountered in riveting the sign symbols to the face of the sign panel, most of the prior signs of this form have been totally constructed in a shop or factory remote from the site of erection and then taken to such site for such erection. In this manner, the tedious riveting fastening of the sign symbols may be accomplished more conveniently and economically since factory-oriented jigs and fixtures may be used and permanently mounted, as opposed to portable, tools may be used. Furthermore in the case of highway signs and particularly those to be erected at or over relatively congested highways presently being used, the period of exposure to the dangers of moving traffic by the workmen or the period of time required to interrupt traffic is greatly reduced.

This present procedure with the presently constructed reflectorized signs may not be excessively troublesome where new signs are involved even though the fabrication and assembly procedures are relatively difficult, the signs can still be fabricated and assembled remote from the highway erection site. However, after signs have been installed and have been used for a period of time, various deteriorating conditions including both normal and the more severe inclement weather conditions result in the requirement that the sign symbols be replaced. Also, as traffic patterns change relative to a given highway or freeway, complete alteration of information symbols can be required or the display of different instructional material.

In either case, with sign symbols mounted by the usual riveting as described, the symbol changing and replacement procedures are obviously quite tedious and time-consuming. If the sign symbols are merely to be renewed, the old symbols are removed by severing the fastening rivets thereof, the new symbols are temporarily secured in place, and the new rivets installed through preexisting or newly formed rivet holes. If completely different sign symbols are to be installed, there is always the tedious forming of new rivet holes prior to rivet installation, and most frequently there will be old, unused rivet holes in the sign panel which must either remain to present an unsightly appearance or must be filled and perhaps will be less noticeable.

One of the prime problems involved is just where these required, difficult sign symbol operations should be performed. If the sign panel is left in its original erected location, the workmen required to perform these operations are necessarily suspended at heights above or adjacent the highways and there is again the necessity of either exposing such workmen to the dangers of traffic congestion or interrupting traffic flow for a relatively long period of time during which the work can be accomplished. The other choice is the dismounting of the entire sign and the performance of the work at ground level either adjacent the highway or by removal of the sign to the factory of shop. In either case, troublesome time and expense are involved.

As a still further important consideration, even though most of the more recent highway signs have been of the described reflectorized construction, there is still the problem of replacement of many old highway sign constructions which were originally not reflectorized. Unless these old non-reflectorized signs are to be completely replaced, the requirement is again presented relative to the replacement of the sign symbols thereof. Again, all of the same problems are involved, that is, rivet removal, new rivet holes, rivet replacement and the problems of just where all of these tedious operations are to be performed.

OBJECTS AND SUMMARY OF THE INVENTION

It is, therefore, an object of this invention to provide reflectorized sign symbols, reflectorized symbol signs, and methods of fabricating and assembling the same wherein the sign symbols are formed in a new and unique manner, each fully reflectorized and each securely mounted on a sign panel face, but without the need of any rivets or other similar mechanical fastening means. According to a preferred embodiment thereof, the sign symbols are formed from flat sheet or strip material, for instance, flat aluminum sheet or strip. The reflectors are mounted with the particular symbols solely through a unique edge abutment within openings of the symbols, thereby securely peripherally engaging and retaining the reflectors in their proper places. The symbols once so fabricated, are then secured flatwise on the face surface of the sign panel in the desired positions by adhesive.

It is a further object of this invention to provide reflectorized sign symbols, reflectorized symbol signs, and methods of fabricating and assembling the same wherein the sign symbols, through the unique formation and sign panel securement thereof, may be mounted on the sign panel at virtually any location and in a minimum amount of time. In view of the fact that no rivit holes need be formed nor rivets installed, the sign symbols, whether information symbols or border forming symbols, are readily adhesively attached in a secure manner to the sign panel face. Thus, depending on what particular conditions might dictate, the sign may be fabricated at the factory or shop, or may be fabricated at the site of erection either before or after sign panel erection, and in the latter instance, even though the workmen are exposed to certain dangers, the time of exposure will be relatively brief and far less than has been occasioned with prior sign constructions.

It is also an object of this invention to provide reflectorized sign symbols, reflectorized symbols signs, and methods of fabricating and assembling the same which, through the unique structure of the various information and border sign symbols and the unique manner of attaching the same to the sign panel face in final sign assembly the final sign assemblies are readily inherently adapted for convenient symbol replacement either in an identical form or in a desired altered form without dismounting of an already erected sign panel and without the exposure of workmen to long periods of possible danger as has been prevalent with the prior sign constructions. With the original sign symbols attached to the sign panel face by the use of selected adhesives, it is possible to remove any one or all of the sign symbols in a minimum period of time and the remounting of new or different sign symbols in an equally minimum amount of time so that even if it is necessary to have the workmen positioned at heights adjacent or over congested highways, or it is necessary to temporarily interrupt traffic on a congested highway, the time elements involved are far less than has heretofore been possible. Equally important, again by reason of the unique original mounting of the sign symbols on the sign panel by use of adhesives without any rivets or other mechanical fastening means being used, removal of original sign symbols and replacement with completely different sign symbols does not leave any evidence of previous sign symbol mounting which could in any way inhibit the newly assembled sign appearance.

It is still an additional object of this invention to provide reflectorized sign symbols, reflectorized symbol signs, and methods of fabricating and assembling the same which satisfies all of the above objects and provides all of the previously discussed advantages, and is further readily adaptable for forming signs of virtually any sign symbol assembly for a minimum of fabrication material and labor costs. According to the preferred method of fabrication, finished metal sheet material in coil or sheet bulk form has an adhesive layer applied to a back surface thereof which is covered by a protective release paper and when a particular sign is to be fabricated, the desired sign symbols including information and border sign symbols may be formed, such as by stamping, therefrom. The various reflectors are then quickly mounted in the adhesive backed sign symbols through the novel edge retainment as hereinbefore briefly discussed resulting in all of the necessary sign symbols for the ultimate sign assembly totally completed and ready for the final panel mounting. Obviously, if quantities of signs be produced warrents, these totally prefabricated sign symbols may be produced in quantity and stocked for limited periods of time ready for the final assembly of a multiplicity of various signs. In any event, the only further procedure involved is the provision of a finished overall sign panel to which the desired prefabricated sign symbols may be readily attached merely be the removal of the sign symbol release paper protecting the adhesive thereof and the abutment of the sign symbols in place against the front surface of the sign panel, this final assembly operation being accomplished in a minimum period of time whether the sign panel is located in the factory or shop, at a site of erection or already erected in place.

Other objects and advantages of the invention will be apparent from the following specification and the accompanying drawings which are for the purpose of illustration only.

DESCRIPTION OF THE BEST EMBODIMENTS CONTEMPLATED:

The unique reflectorized sign symbol and sign construction, and method of forming the same of the present invention are illustrated herein in preferred embodiment form incorporated is a usual highway directional sign. It is pointed out, however, that the principles of the present invention are equally well adaptable to many other forms and shapes of signs for many other uses and that it is not intended to limit the principles of the present invention to the specific construction and method embodiments shown. Furthermore, although in the following preferred elements of structure and fabrication steps will be described, many conventional fabrication materials and procedures may be used and, in any event, it is not intended to thereby limit the principles of the present invention beyond the scope of the appended claims.

Figure 2:
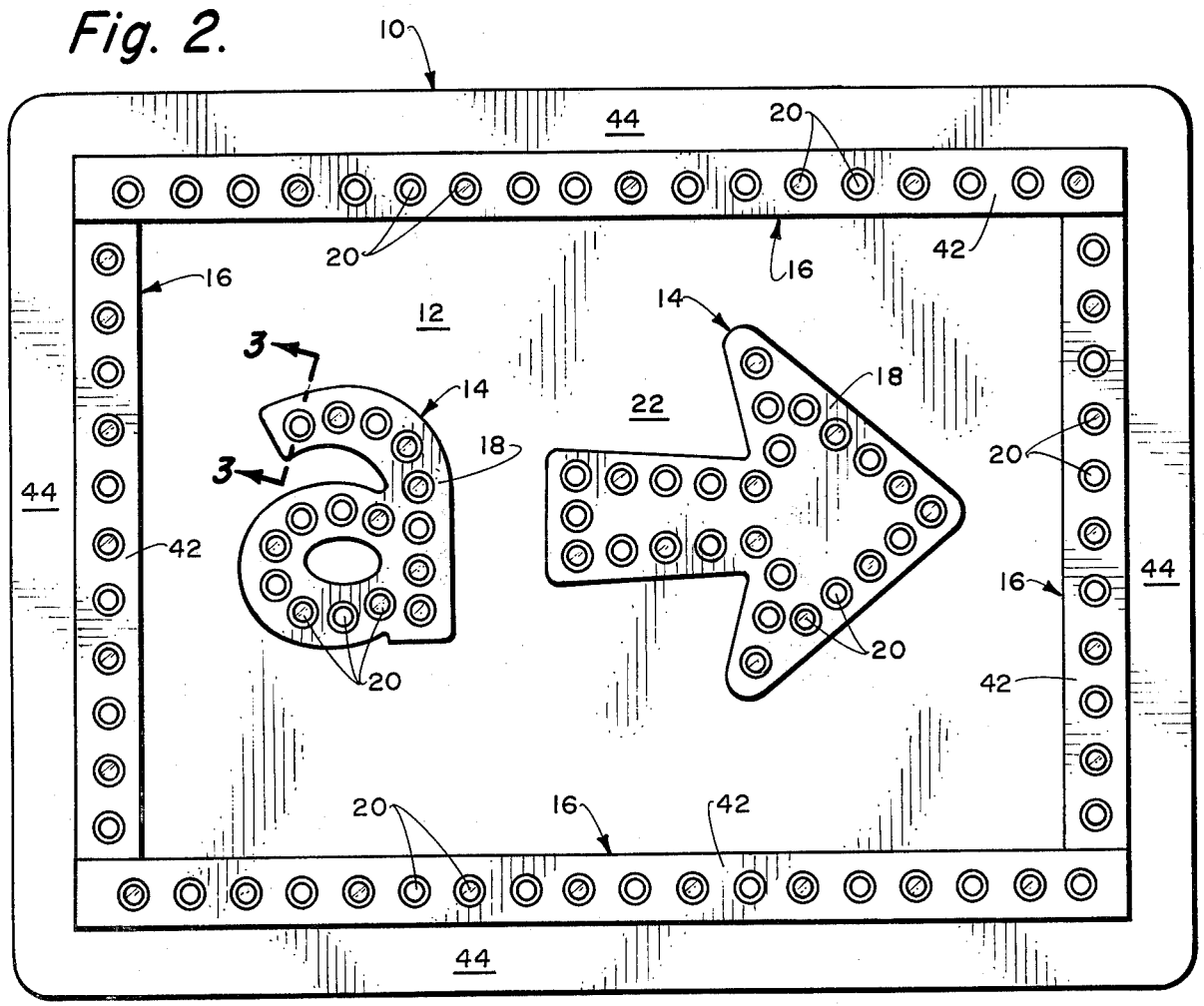
FIG. 2 is a front elevational view of a typical assembled highway sign illustrating a preferred embodiment of the construction and method principles of the present invention.
Figure 3:
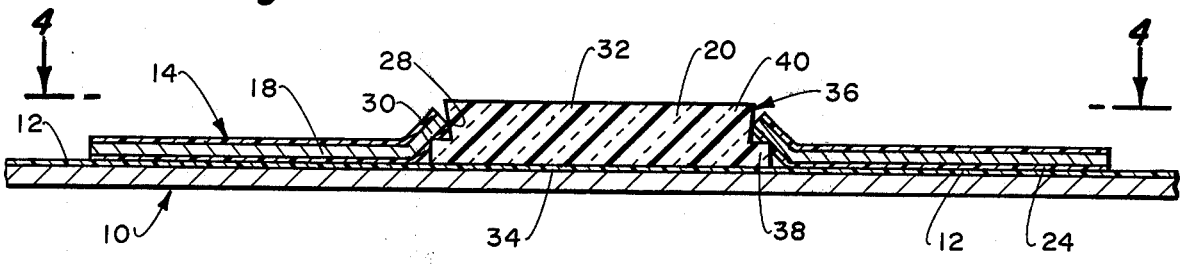
FIG. 3 is an enlarged, fragmentary, sectional view looking in the direction of the arrows 3–3 in FIG. 2 and illustrating the construction and assembly of the sign information symbols.
Figure 4:
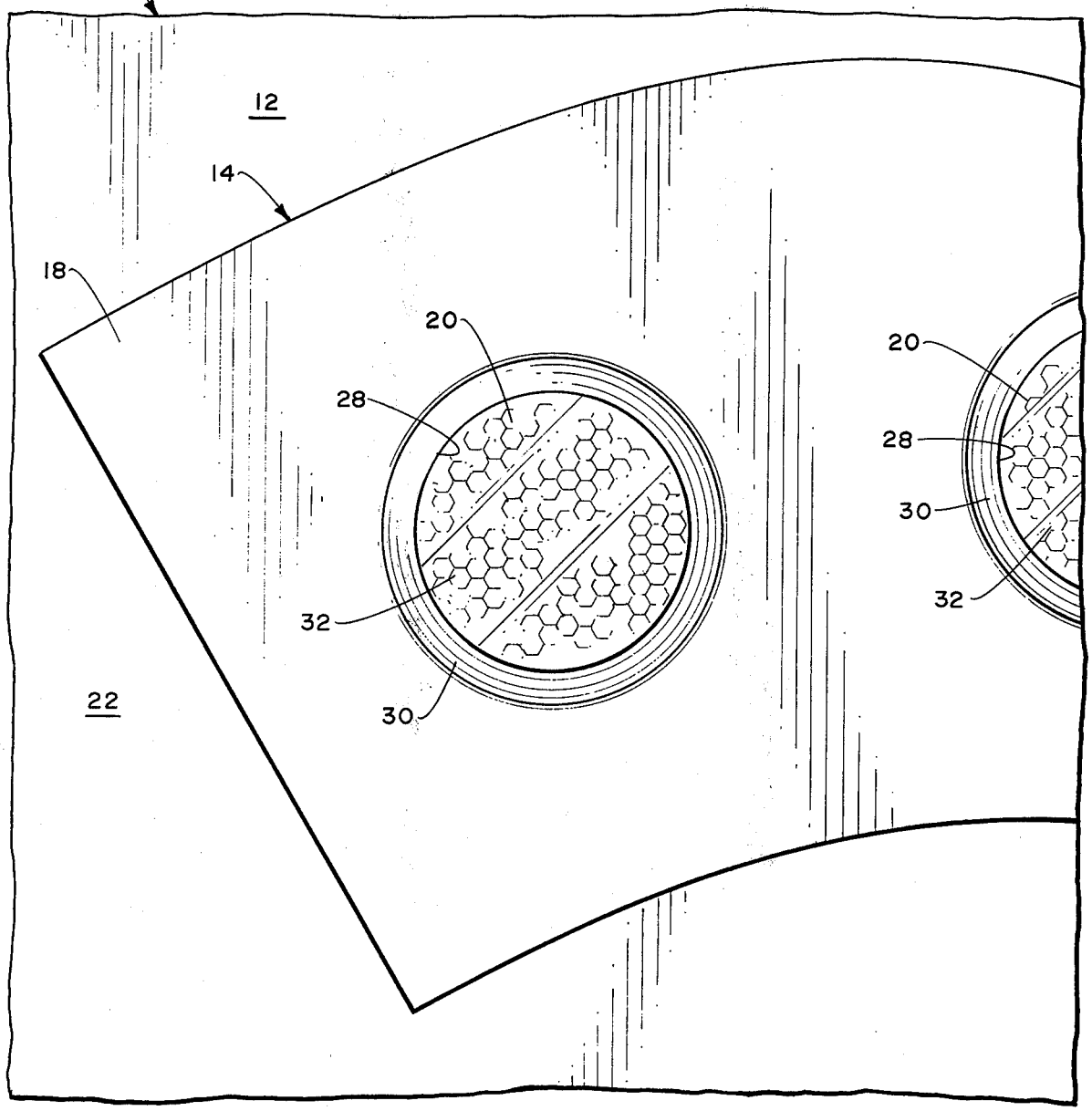
FIG. 4 is a fragmentary, top plan view looking in the direction of the arrows 4—4 in FIG. 3.

Initially referring to FIGS. 2, 3 and 4, the illustrated embodiment of highway directional sign includes a usual sign panel generally indicated at 10 having a preferably flat, appropriately finished, front panel face 12. The sign panel 10 may be formed of any usual, preferably relatively thin, material appropriate for the intended purpose, for instance, steel sheet protectively and decoratively finished with baked porcelain enamel, any of the appropriate plastics, and aluminum sheet finished in any one of a multiplicity of manners including baked porcelain enamel. Also, the sign panel 10 may be appropriately reinforced for strength and durability and may be suspended on usual sign standards or suspension members adjacent or overlying highways and freeways, all according to usual practice.

Mounted on the front panel face 12 of the sign panel 10 are a multiplicity of sign symbols, information sign symbols generally indicated at 14 preferably circumscribed by border sign symbols generally indicated at 16, the front panel face mounting thereof to be discussed below. The information sign symbols 14 may be comprised of virtually any size and shape depicting the usual sign information, such as letters, directional arrows, numerals and any other desired information, an "*a*" and "arrow" being shown in FIG. 2 for illustration purposes. The border sign symbols 16 may likewise be formed in a series of shapes, most frequently completely enclosing the information sign symbols 14 on the front panel face 12. As illustrated in FIG. 2, the individual border sign symbols may be elongated, generally rectangular in configuration and preferably assembled to form a continuous border.

More specifically, the information sign symbols 14 are each formed with a symbol body 18 preferably stamped from coiled or flat stock of relatively thin, flat sheet metal, preferably forwardly surface finished, such as sheet aluminum at least forwardly finished by baked porcelain enameling although these symbol bodies could be formed of other materials, such as thin sheet steel or plastic by slightly more complex fabricating procedures. The individual symbol bodies 18 are contoured to form the appropriate information designation and each has a multiplicity of spaced reflectors 20 positioned retained therein in a unique manner to be described below. The reflectors 20 may be formed of any usual materials in the usual manner, preferably plastic materials for economy and durability, those shown being wafer-like and round in general configuration.

As is clearly shown in FIG. 2, the multiplicity of spaced reflectors 20 are positioned in each of the symbol bodies 18 so as to generally outline the specific contour of that symbol body. As is usual, therefore, during minimum light conditions, the reflectors 20 will convey the same intended information as the symbol bodies 18. Thus, as will be described more in detail below, the various symbol bodies 18 having the reflectors 20 mounted therein are properly positioned secured to a centralized portion 22 of the front panel face 12 by an adhesive layer 24 (FIGS. 3, 5, 7, 8) preferably a pressure sensitive adhesive layer of usual composition appropriate for bonding the information sign symbols 14 to the sign panel 10 and preferably originally covered by a layer of usual release paper 26 (FIGS. 5, 7, 8).

Figure 5:
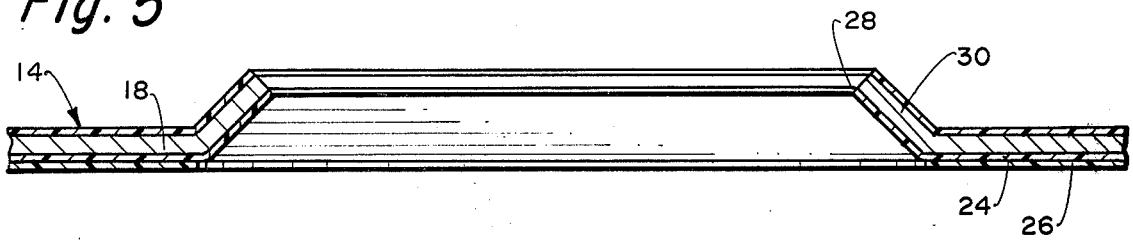
FIG. 5 is a slightly enlarged, fragmentary, sectional view similar to FIG. 3, but merely showing a portion of the sign symbol of FIG. 3 prior to assembly with the sign panel and prior to assembly of the reflector therein.
Figure 6:
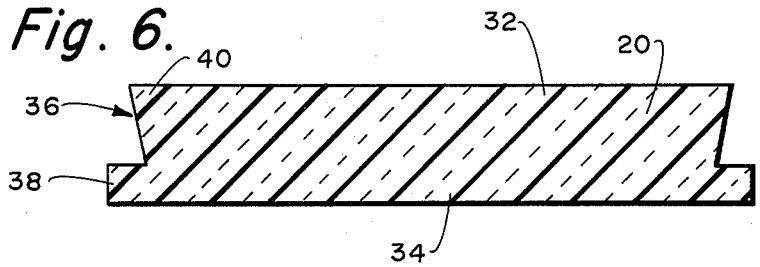
FIG. 6 is a sectional view of the reflector ready for assembly into the sign symbol of FIG. 5.
Figure 7:
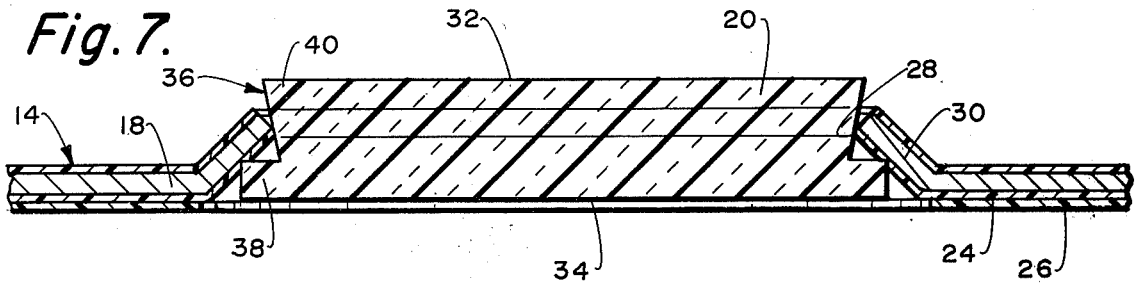
FIG. 7 is a fragmentary, sectional view similar to FIG. 5, but with the reflector of FIG. 6 assembled with the sign symbol of FIG. 5.
Figure 8:
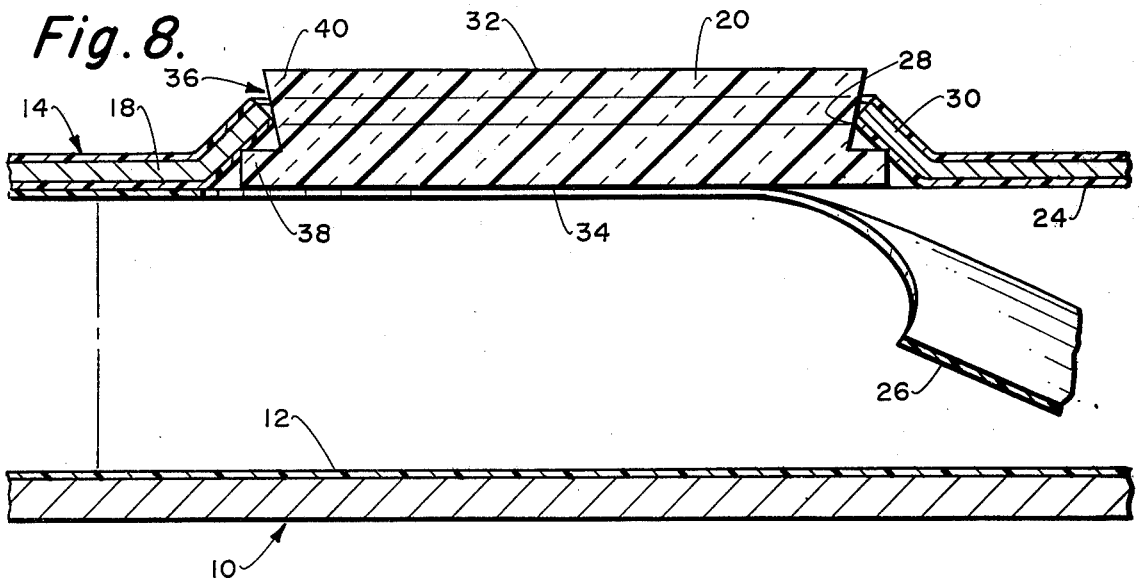
FIG. 8 is a fragmentary, sectional view similar to FIG. 7, but with the sign symbol and reflector assembly of FIG. 7 in the process of being assembled with the sign panel.

More particularly to the unique retainment of the spaced reflectors 20 in the information sign symbols 14 and referring to FIGS. 5, 6, and 7, it will be noted that FIG. 7 illustrates a portion of the information sign symbol 14 depicting the letter "*a*" in FIG. 2 and looking in the direction of the section line 3—3 in FIG. 2, but with the information sign symbol 14 not yet mounted with the sign panel 10. Furthermore, FIGS. 5, 6 and 7 in sequence illustrate the construction of the information sign symbol 14 and a reflector 20 prior to and after assembly of the reflector in the information sign symbol. All other reflectors 20 are identically mounted in the information sign symbols 14 so that this showing will suffice for all.

Referring to FIG. 5, and considering only the mounting of the single reflector 20, after the initial formation of the particular information sign symbol 14 having the adhesive layer 24 and protective release paper 26 preassembled therewith, either simultaneously with the original information sign symbol formation or immediately following, a reflector opening 28 is formed therethrough including the adhesive layer and release paper. The reflector opening 28 during such formation is formed with forwardly angled edge portions 30 peripherally defining the opening, the edge portions 30 angling forwardly preferably at less than 90° and preferably in the order of 40° to 50° as shown. Furthermore, during the formation of the reflector opening 28 and its forwardly angled edge portions 30, the ring of release paper 26 covering the forwardly angled edge portions 30 is stripped from the adhesive layer 24 inwardly exposing such adhesive layer, again as shown in FIG. 5.

As shown in FIG. 6, the wafer-like reflector 20 is of general cylindrical configuration having round, preferably flat, front and back faces 32 and 34, thereby requiring the reflector opening 28 and opening edge portions 30 to be round. The annular edge generally indicated at 36 of the reflector 20 is preferably formed with a back or rearward part 38 and a front or forward part 40, the front part 40 being stepped inwardly from the back part 38. In addition, the front part 40 is preferably angled slightly outwardly in its forward extension from the back part 38 as shown. In dimensioning, the periphery of the back part 38 is spaced larger than the reflector opening 28, approximately midway of the forwardly angled edge portions 30 and the front part 40 is spaced smaller than the reflector opening at its rearward extremity adjacent the back part and angles outwardly to spaced larger than the reflector opening at its forward extremity.

To assemble the reflector 20 of FIG. 6 into the reflector opening 28 of FIG. 5, the reflector is inserted from rearwardly forward, the reflector front part 40 flexing the opening forwardly angled edge portions 30 outwardly and then permitting the same to flex back inwardly during such insertion. This positions the opening forwardly angled edge portions 30 overlying the reflector back part 38 and the edge of the forwardly angled edge portions inwardly, preferably slightly pressure engaging the reflector front part 40 intermediate the reflector front part forward extension. Thus, the reflector 20 is positively positioned against forward movement by engagement with the overlying opening forwardly angled edge portions 30 and is positively retained positioned against rearward movement by edge engagement with the opening forwardly angled edge portions against the reflector front part 40. At the same time, the exposed adhesive layer 24 on the opening forwardly angled edge portions 30 against the reflector back and front parts 38 and 40 will also aid in such reflector retainment.

The border sign symbols 16 are quite similarly formed and mounted, the elements thereof merely having different shapes for providing their intended elongated border function. Referring to FIG. 2, the border sign symbols 16 are each formed with a generally rectangular symbol body 42 preferably from the same thin sheet aluminum material preferably forwardly finished and by stamping as in the case of the previously described information sign symbols 14. The same reflectors 20 are mounted edge retained therein in the identical manner as in the information sign symbols 14 as described above, the reflectors being spaced along these border sign symbols 16 to define the general extension thereof just as with the information sign symbols.

The border sign symbols 16 are positioned secured to an outer border portion 44 of the front panel face 12 by a similar adhesive layer again preferably a pressure sensitive adhesive layer preferably originally release paper covered, the border sign symbols 16 being positioned end to end to form an appropriate border encircling or circumcribing the information sign symbols 14. Both the information and border sign symbols 14 and 16 have the symbol bodies 18 and 42 thereof, as well as the reflectors 20 thereof, formed of contrasting colors different from the finish of the front panel face 12 of the sign panel 10. Thus, a completed sign of unique symbol construction is formed which is clearly discernable as to the various elements thereof both in bright daylight and in minimum light conditions.

Figure 1:
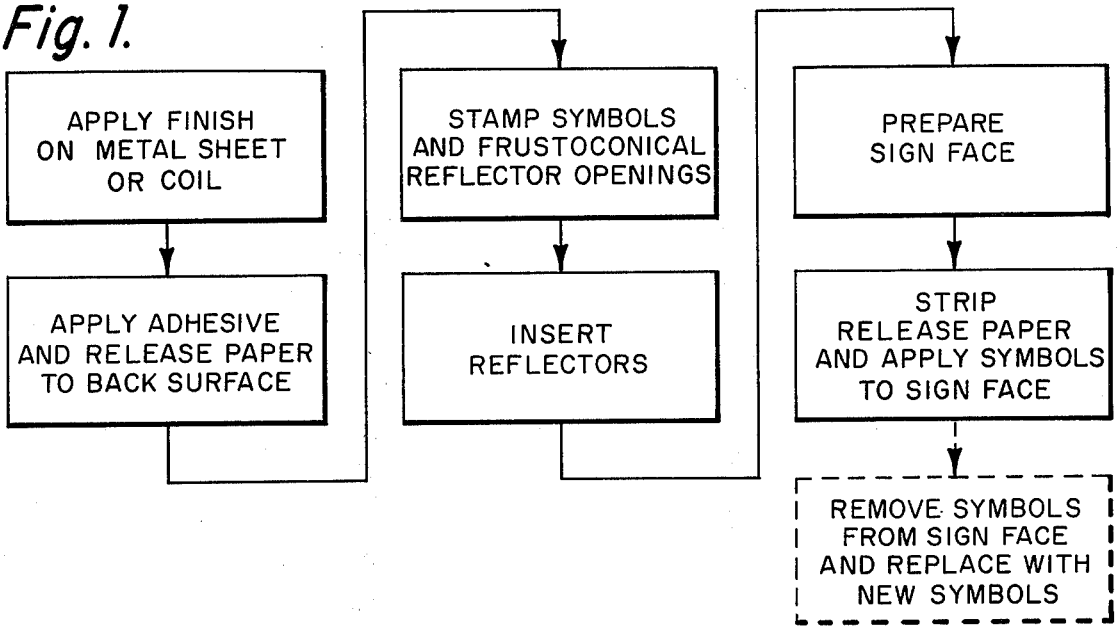
FIG. 1 is a method step layout illustrating the preferred method steps of fabricating and assembling preferred embodiments of reflectorized sign symbols and a reflectorized symbol sign according to the principles of the present invention.

According to the preferred method of fabricating and assembling the reflectorized letter sign construction of the present invention and as is briefly outlined in step form in FIG. 1, coil or sheet thin aluminum sheet stock is first surface finished in any usual and appropriate manner. A thin layer of preferably pressure sensitive adhesive is then applied covering the back surface thereof, such back surface ultimately forming the back surfaces of the information and border sign symbols 14 and 16. This adhesive layer is provided with a back covering thereon of usual release paper so that the same is protected during the later fabrication of the information and border sign symbols 14 and 16 and until such sign symbols are actually mounted on a sign panel 10.

The various required information and border sign symbols 14 and 16 are then stamped from this aluminum sheet stock andd in view of the previous application of the adhesive layer and release paper covering, the formed information and border sign symbols 14 and 16 will have backings of adhesive layers 24 adhering thereto, in all cases at this stage covered with the release paper 26. In the same stamping operation or a subsequent stamping operation, the reflector openings 28 are formed having the appropriately shaped forwardly angled edge portions 30 and at appropriate spaced locations depending on whether it is a symbol body 18 for an information sign symbol 14 and the specific contour thereof or a symbol body 42 for a border sign symbol 16. The reflectors 20 are then inserted edge secured into the information and border sign symbols 14 and 16 as hereinbefore described.

Each of the information and border sign symbols 14 and 16 is now ready for ultimate mounting on the front panel face 12 of the sign panel 10, the particular sign panel having been previously prepared. The actual sign symbol mounting operating merely requires the peeling or stripping off of the release paper 26 on the particular information or border sign symbol 14 or 16, for instance, in the manner shown in FIG. 8 and the abutment of the particular sign symbol against the front panel face 12 in its appropriate position as is also illustrated in FIG. 8. As previously described, the information sign symbols 14 will be adhesively secured at proper locations within the centralized portion 22 of the front panel face 12 and the border sign symbols 16 in proper alignment circumscribing the information sign symbols at the outer border portion 44 of the front panel face.

Thus, it is seen that with a previously prepared sign panel 10 and the pre-prepared reflectorized information and border sign symbols 14 and 16, the final sign assembly is quickly and easily accomplished with a minimum of labor and a minimum amount of time thereby adapting the final sign assembly for accomplishment at virtually any location and even under moderate adverse conditions, such as under adverse traffic conditions adjacent or suspended above a traffic congested highway or freeway. No tedious drilling operations are necessitated as has been true of the prior sign constructions. Furthermore, after a period of use of such a highway sign, if sign symbol renewal is required or if the information sign symbols 14 are to be completely replaced by different information conveying sign symbols, particularly if the proper adhesives have originally been selected, it is possible to relatively quickly remove the previous information sign symbols and replace the same. If the information sign symbols 14 are replaced with completely different information sign symbols, such is of no consequence since no drilled holes are involved and therefore will not adversely affect the renewed or changed sign appearance.

I claim:

1. In a reflectorized sign symbol construction adapted for attachment to a generally flat front face of a sign panel; the combination of: a sheet-like sign symbol having generally flat front and back faces with at least one reflector opening therethrough, symbol forwardly angled edge portions projecting only forwardly of said front and back faces peripherally defining said reflector opening at and forwardly of said front and back faces; a reflector extending through said symbol reflector opening and having edge surfaces adjacent said symbol angled edge portions, said reflector having a back face generally parallel to and aligned with said symbol back face providing a symbol and reflector coextensive back face for mounting on a flat surface; abutment means between said symbol angled edge portions and said reflector edge surfaces for retaining said reflector in said symbol opening and positively resisting forward and rearward movement of said reflector relative to said symbol angled edge portions; said reflector edge surfaces including inwardly stepped edge surfaces from rearwardly to forwardly forming rearward surface parts and forward surface parts, said symbol angled edge portions overlying said reflector rearward surface parts and pressure edge engaging said reflector forward surface parts, said pressure engagement forming at least a part of said abutment means.

2. In a reflectorized sign symbol construction as defined in claim 1 in which said reflector edge forward surface parts angle outwardly forwardly from said rearward surface parts.

3. In a reflectorized sign symbol construction as defined in claim 1 in which said symbol back face has a release paper covered adhesive layer adhering thereto, said reflector and opening being formed through said release paper and adhesive and forwardly through said symbol.

4. In a reflectorized sign construction; the combination of: a sign panel having a generally flat front face; at least one sheet-like sign symbol having generally flat front and back faces with at least one reflector opening therethrough, symbol forwardly angled edge portions projecting only forwardly of said front and back faces peripherally defining said reflector opening at and forwardly of said front and back faces; a reflector extending through said symbol reflector opening and having edge surfaces adjacent said symbol angled edge portions, said reflector having a back face providing a symbol and reflector coextensive back face for mounting on a flat surface; abutment means between said symbol angled edge portions and said reflector edge surfaces for retaining said reflector in said symbol opening and positively resisting forward and rearward movement of said reflector relative to said symbol angled edge portions, said reflector edge surfaces including inwardly stepped edge surfaces from rearwardly to forwardly forming rearward surface parts and forward surface parts, said symbol angled edge portions overlying said reflector rearward surface parts and pressure edge engaging said reflector forward surface parts, said pressure engagement forming at least a part of said abutment means; said sign symbol and reflector being positioned on said sign panel generally flat front face with a film of adhesive adhering said symbol back face to said panel front face.

5. In a reflectorized sign construction as defined in claim 4 in which said reflector edge forward surface parts angle outwardly forwardly from said rearward surface parts.

6. In a reflectorized sign construction as defined in claim 4 in which each of said sign panel and said sign symbol are formed of relatively thin flat sheet metal with said sign symbol forwardly angled edge portions being integral with said sign symbol.

7. In a reflectorized sign symbol construction adapted for attachment to the front face of a sign panel; the combination of: a sign symbol having front and back faces with at least one reflector opening therethrough, symbol forwardly angled edge portions peripherally defining said reflector opening; a reflector extending through said symbol reflector opening and having edge surfaces adjacent said symbol angled edge portions; abutment means between said symbol angled edge portions and said reflector edge surfaces for retaining said reflector in said symbol opening and positively resisting forward and rearward movement of said reflector relative to said symbol angled edge portions; said symbol back face having a release paper covered adhesive layer adhering thereto, said reflector opening being formed through said release paper and adhesive; said adhesive layer on said symbol angled edge portions being free of release paper thereon and abutting portions of said reflector edge surfaces so as to form at least part of said abutment means and at least aid in retaining said reflector in said symbol opening.

8. In a reflectorized sign symbol construction as defined in claim 7 in which said reflector edge surfaces include parts underlying said symbol angled edge portions and parts pressure engaged with said symbol angled edge portions, said pressure engagement forming at least a part of said abutment means.

* * * * *